US006240795B1

(12) United States Patent
Kurtzer

(10) Patent No.: US 6,240,795 B1
(45) Date of Patent: Jun. 5, 2001

(54) CAM-CONTROLLED POWER DIFFERENTIAL GEAR FOR A SHEET ACCELERATION SYSTEM

(75) Inventor: Siegfried Kurtzer, Mannheim (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 0 days.

(21) Appl. No.: 09/217,857

(22) Filed: Dec. 21, 1998

(30) Foreign Application Priority Data

Dec. 20, 1997 (DE) ..... 197 57 158

(51) Int. Cl.[7] ..... F16H 25/08; F16H 25/16

(52) U.S. Cl. ..... 74/53; 74/116; 101/147; 101/247; 101/352

(58) Field of Search ..... 74/53, 54, 55, 74/40, 45, 116, 117; 101/142, 147, 217, 247, 352

(56) References Cited

U.S. PATENT DOCUMENTS 3,888,129 * 6/1975 Velan et al. ..... 74/29
4,416,198 * 11/1983 Rasenberger ..... 101/3 R
4,583,728 * 4/1986 Mathes ..... 271/268
4,854,236 * 8/1989 Thünker et al. ..... 101/411
5,544,546 * 8/1996 Döpke ..... 74/569

FOREIGN PATENT DOCUMENTS

4109824A1 10/1991 (DE) .
19532856A1 3/1997 (DE) .

* cited by examiner

*Primary Examiner*—David Fenstermacher
(74) *Attorney, Agent, or Firm*—Hebert L. Lerner; Laurence A. Greenberg; Werner H. Stemer

(57) ABSTRACT

A cam-controlled power differential gear transmission for a sheet acceleration system, which is formed of a pregripper having an acceleration course determinable by a control cam driven at a single speed, includes two compensating masses pivotably supported diametrically opposite one another, and respective control cams assigned to the compensating masses, respectively, for controlling the pivoting motion thereof.

8 Claims, 4 Drawing Sheets

CAM-CONTROLLED POWER DIFFERENTIAL GEAR FOR A SHEET ACCELERATION SYSTEM

BACKGROUND OF THE INVENTION

Field of the Invention

The invention relates to a cam-controlled power differential gear for a sheet acceleration system, which is formed of a pregripper having an acceleration course determinable by a control cam driven at a single speed.

In sheet-fed rotary printing presses, it is customary for a sheet oriented on a feeding table to be gripped by a sheet acceleration system formed as a pregripper, and accelerated up to processing speed. After transferring the sheet to a sheet transport drum, the pregripper is decelerated down to a standstill and then is reaccelerated in the direction of the feeding table, with a subsequent deceleration down to a standstill at the feeding table. Because of the cyclical motion of the sheet acceleration system over a machine cycle, forces of inertia are generated which create torques acting upon the control cam; these torques are superimposed upon the torques operative in the drive system and thus cause torque fluctuations which, in the final analysis, cause registration errors and doubling or double impressions, respectively, which consequently lead to defective quality or a rejection of the printed products. The torque fluctuations also cause increased wear of the printing press.

From the published German Patent Document DE 41 09 824 A1, a cam-controlled power differential gear has become known heretofore which minimizes the afore-described problems. To that end, four compensating masses are provided, offset from one another by 90°, which engage with a common compensating cam. Rollers respectively assigned to one compensating mass pass per period, i.e., one reciprocating pivoting motion of the pregripper, through two identical motion segments without a resting phase at a sheet transfer location on the feeding table. The length of the resting phase is in fact determined solely by the reversal point of the pregripper on the feeding table. This very severely restricts the free choice of a pregripper motion principle.

SUMMARY OF THE INVENTION

It is accordingly an object of the invention to provide a cam-controlled power differential gear for a sheet acceleration system wherein the principle of motion for the pregripper is freely selectable.

With the foregoing and other objects in view, there is provided, in accordance with the invention, a cam-controlled power differential gear transmission for a sheet acceleration system, which is formed of a pregripper having an acceleration course determinable by a control cam driven at a single speed, comprises two compensating masses pivotably supported diametrically opposite one another, and respective control cams assigned to the compensating masses, respectively, for controlling the pivoting motion thereof.

In accordance with another feature of the invention, the control cams for controlling the pivoting motion of the compensating masses are disposed on a common axis, and the differential gear transmission includes another control cam for generating a pivoting motion of the pregripper, the other control cam being disposed on an axis parallel to the common axis.

In accordance with a further feature of the invention, the control cams for controlling the pivoting motion of the compensating masses and another control cam for generating a rocking motion of the pregripper are disposed on a common axis.

In accordance with an added feature of the invention, one of the control cams is an inner control cam, and the other of the control cams is an outer control cam.

In accordance with an additional feature of the invention, the control cams for controlling the pivoting motion of the compensating masses are fixed to a machine frame, and the other control cam for generating a pivoting motion of the pregripper is disposed in a rotatably drivable manner.

In accordance with yet another feature of the invention, the pregripper has a resting phase on a feeding table amounting to a machine angle $\phi$=approximately 60°.

In accordance with yet an added feature of the invention, the compensating masses are able to execute a pivoting motion even during the resting phase.

In accordance with a concomitant feature of the invention, the power differential gear transmission includes control rollers, respectively, assigned to the control cams, each of the control rollers having a roller lever, and each roller lever having an abutment for bracing against a compression spring.

An advantage of the invention is that by the free choice of the principle of motion of the pregrippers, the resting phase upon sheet transfer from the feeding table can be given such a length that a calm sheet transfer is possible.

If an angle of approximately 60° is provided, the resting phase of the pregripper on the feeding table is very long, thus assuring a calm sheet transfer.

Pivotally supported compensating masses are provided at locations diametrically opposite one another. This provision achieves good balancing of the power differential gear transmission.

A compression spring provided between control rollers for the pivoting motion of the compensating masses improves the contact of the control rollers with the various control cams to which they are assigned.

In the second exemplary embodiment, provision is made for the control cam effecting the oscillating motion of the pregripper to be disposed on a common axis of the control cams effecting the pivoting motion of the compensating masses.

Other features which are considered as characteristic for the invention are set forth in the appended claims.

Although the invention is illustrated and described herein as embodied in a cam-controlled power differential gear for a sheet acceleration system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
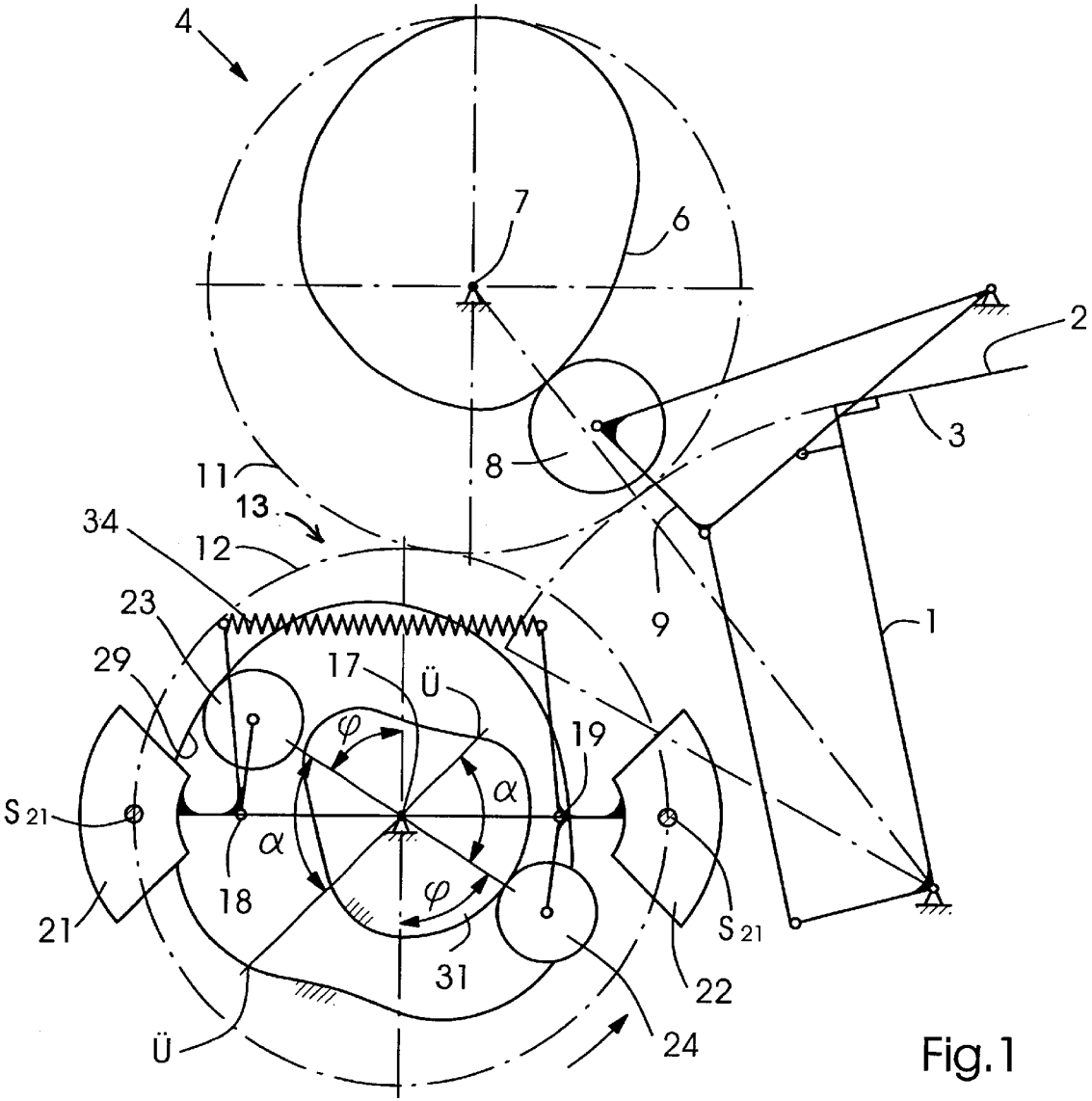
FIG. 1 is a diagrammatic front elevational view of a first exemplary embodiment of a power differential gear transmission according to the invention.
Figure 2:
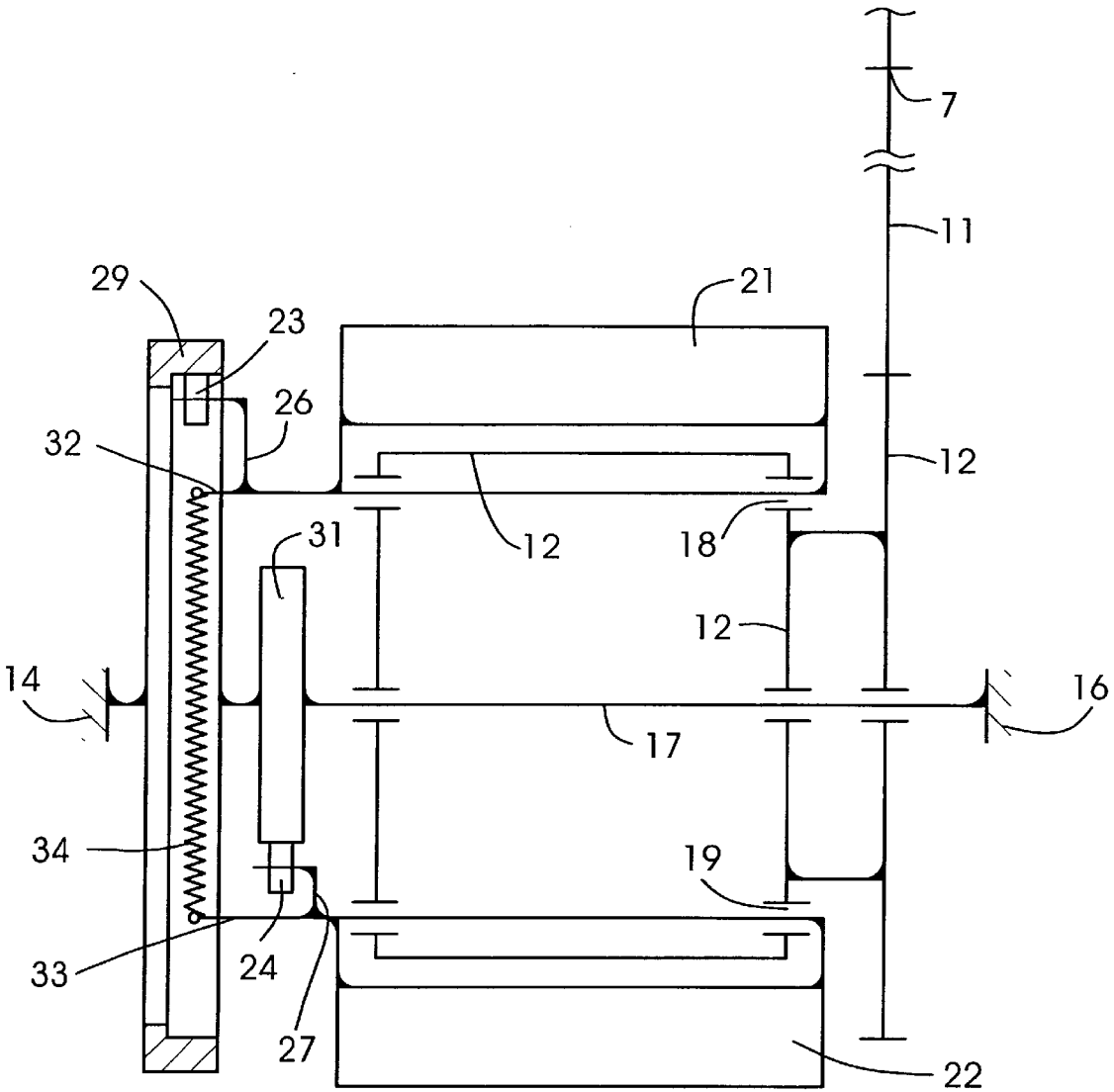
FIG. 2 is a diagrammatic side elevational view, partly in section, of FIG. 1.

Referring now to the drawings and, first, particularly to FIGS. 1 and 2 thereof, there is shown therein a pregripper 1 of a sheet-fed rotary printing press which accepts a sheet 2 from a feeding table 3, accelerates it, and then transfers it to a sheet transport drum 4. An oscillating motion of the pregripper 1 is initiated by a control cam 6, which has a common rotary axis 7 with the sheet transport drum 4. The control cam 6 cooperates with a control roller 8, which is connected to the pregripper 1 by a four-bar linkage 9. A gear wheel 11 of the sheet transport drum 4 meshes with a gear wheel 12 of a power differential gear transmission 13. The gear wheel 12 is rotatably supported on an axis 17 firmly fixed in side frames 14 and 16 of the printing press. The gear wheel 12 has, in an outer region thereof, two diametrically opposed bearing points 18 and 19, each for a respective compensating mass 21, 22. Each compensating mass 21, 22 has a respective roller lever 26, 27 supporting a respective control roller 23, 24. The control roller 23 of the compensating mass 21 is in rolling contact with an inner control cam 29, and the control roller 24 of the compensating mass 22 is in rolling contact with an outer control cam 31. The center points of the control cams are located on the axis 17. Two abutments 32 and 33, each mounted on the respective roller levers 26 and 27, receive a compression spring 34, which assures contact of the control rollers 23 and 24 with the respective control cams 29 and 31 thereof.

Figure 3:
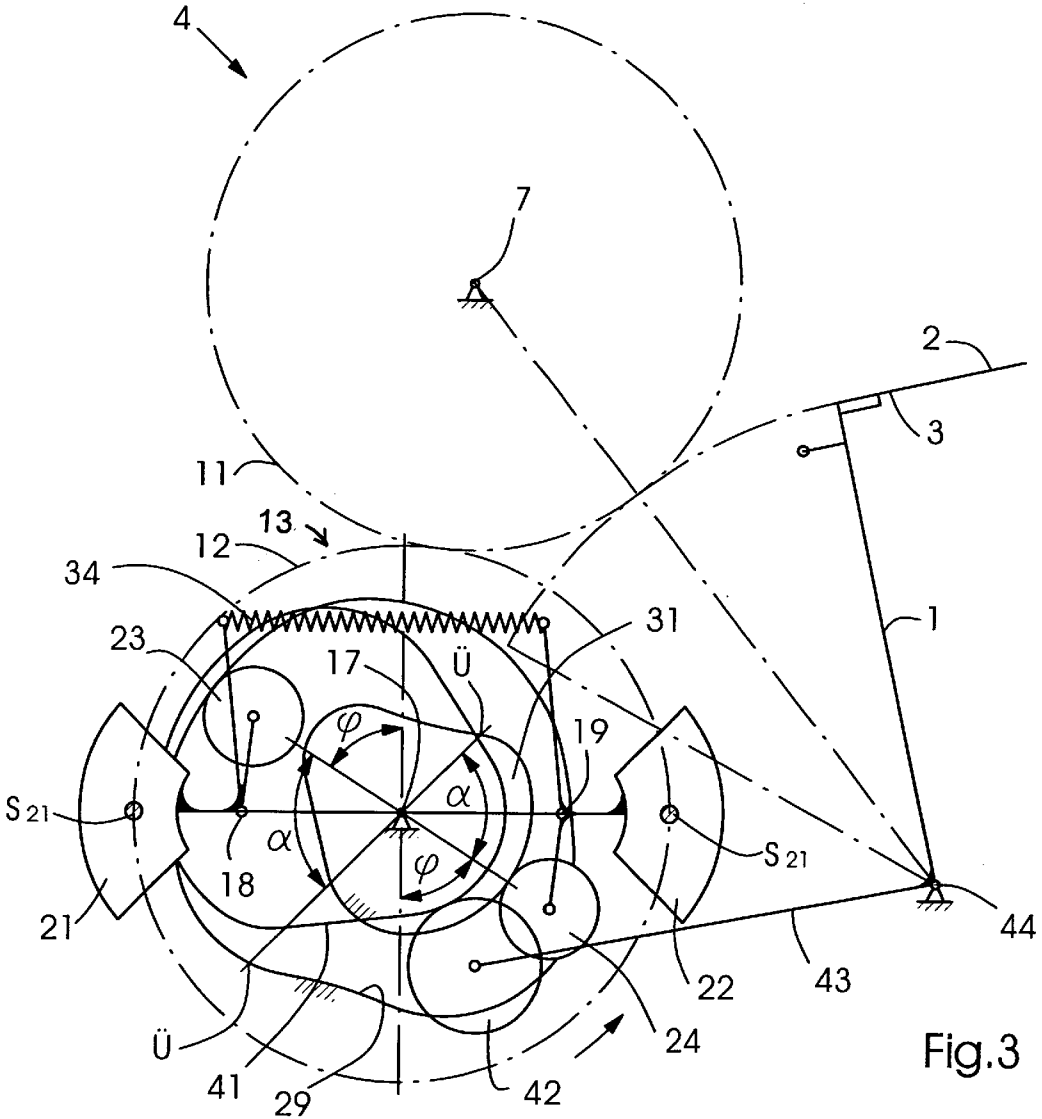
FIG. 3 is a view like that of FIG. 1 of a second exemplary embodiment of the invention.
Figure 4:
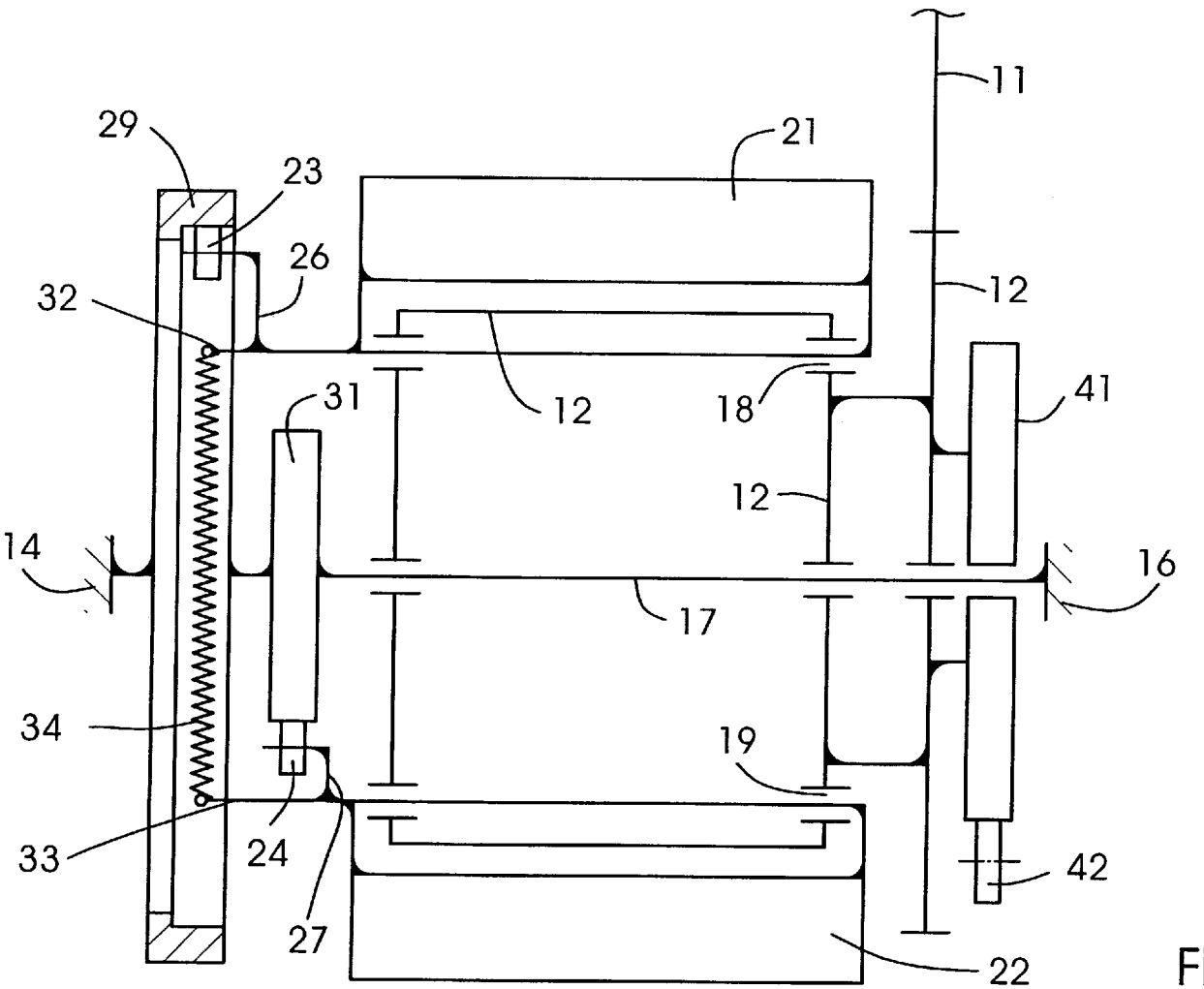
FIG. 4 is a view like that of FIG. 2 of the second exemplary embodiment of the invention shown in FIG. 3.

In a second exemplary embodiment shown in FIGS. 3 and 4, provision is made for a control cam 41 for effecting a rocking motion of the pregripper 1 to be disposed rotatably drivable on the axis 17 of the differential gear 13. The control cam 41 is thus seated jointly on the axis 17 of the differential gear transmission 13 with the control cams 29 and 31, which are fixedly disposed on the frame 14, 16, and is in rolling contact with a control roller 42 disposed rotatably on the end of a roller lever 43. The roller lever 43 is secured to the pregripper 1 and pivots together with the pregripper 1 about a bearing point 44 fixedly connected to the frame.

During one motion cycle of the pregripper 1, the gear wheel 12 rotates once about its own axis 17. The contours of the control cams 29 and 31, respectively, via the respective control rollers 23 and 24 and the respective roller levers 26 and 27, generate a pivoting motion of the respective compensating masses 21 and 22. The contours are selected so that a pivoting motion of the compensating mass 21 with respect to its bearing point 18 executes the same pivoting motion as the compensating mass 22 with respect to its bearing point 19.

The control rollers 23 and 24, in the views of FIGS. 1 and 3, respectively, are shown located at the end of the resting phase of the pregripper 1 on the feeding table 3. The resting phase amounts to approximately $\phi$=60°.

The compensating masses 21 and 22, in the resting phase of the pregripper 1, experience a motion relative to the gear wheel 12 due to the cam disks 29 and 31, the gear wheel 12 rotating at a constant angular speed. Because the center of gravity $S_{21}$, $S_{22}$ of the respective compensating masses 21 and 22, however, is eccentric to the respective pivot points 18 and 19 of the masses, the motion is such that the kinetic energy of the compensating masses 21 and 22, which is composed of rotational and translational energy, does not change in the resting phase of the pregripper 1, and consequently no driving moment about the gear-wheel axis 17 is generated.

The rotational energy, and the translational energy as well, do vary as a consequence of the rotary motion of the compensating masses 21 and 22, however, with a different sign, i.e., +or −, so that the sum of the change and thus the drive moment has a zero value.

The transfer point Ü of the sheet 2 from the pregripper 1 to the downline sheet transport drum 4 is located on the control cams 29 and 31 at approximately $\alpha$=80° after the end of the resting phase.

An arrow in FIGS. 1 and 3 indicates the direction of rotation of the gear wheel 12 and thus of the power differential gear transmission 13.

I claim:

1. A cam-controlled power differential gear transmission for a sheet acceleration system, which is formed of a pregripper having an acceleration course determinable by a control cam driven at a single speed, comprises two compensating masses pivotably supported diametrically opposite one another, and respective control cams assigned to said compensating masses, respectively, for controlling the pivoting motion thereof.

2. The power differential gear transmission according to claim 1, wherein said control cams for controlling the pivoting motion of said compensating masses are disposed on a common axis, and including another control cam for generating a pivoting motion of the pregripper, said other control cam being disposed on an axis parallel to said common axis.

3. The power differential gear transmission according to claim 1, wherein said control cams for controlling the pivoting motion of said compensating masses, and another control cam for generating a rocking motion of the pregripper are disposed on a common axis.

4. The power differential gear transmission according to claim 1, wherein one of said control cams is an inner control cam, and the other of said control cams is an outer control cam.

5. The power differential gear transmission according to claim 3, wherein said control cams for controlling the pivoting motion of said compensating masses are fixed to a machine frame, and said other control cam for generating a pivoting motion of the pregripper is disposed in a rotatably drivable manner.

6. The power differential gear transmission according to claim 1, wherein the pregripper has a resting phase on a feeding table amounting to a machine angle $\phi$=approximately 60°.

7. The power differential gear transmission according to claim 6, wherein said compensating masses are able to execute a pivoting motion even during said resting phase.

8. The power differential gear transmission according to claim 1, including control rollers, respectively, assigned to said control cams, each of said control rollers having a roller lever, and each roller lever having an abutment for bracing against a compression spring.

* * * * *